United States Patent [19]

Broussard

[11] 4,057,108

[45] Nov. 8, 1977

[54] COMPLETING WELLS IN DEEP RESERVOIRS CONTAINING FLUIDS THAT ARE HOT AND CORROSIVE

[75] Inventor: Leo P. Broussard, Picayune, Mich.

[73] Assignee: Shell Oil Company, Houston, Tex.

[21] Appl. No.: 743,267

[22] Filed: Nov. 19, 1976

[51] Int. Cl.[2] ..... E21B 33/10; E21B 43/00

[52] U.S. Cl. ..... 166/314; 166/244 C; 166/242; 166/310

[58] Field of Search ..... 166/314, 315, 303, 244 C, 166/310, 242

[56] References Cited

U.S. PATENT DOCUMENTS

| | | | |
|---|---|---|---|
| 2,713,908 | 7/1955 | Curtis | 166/244 C X |
| 2,982,360 | 5/1961 | Morton et al. | 166/244 C X |
| 3,467,195 | 9/1969 | McAuliffe et al. | 166/314 |
| 3,580,336 | 5/1971 | Meldau | 166/314 X |
| 3,782,468 | 1/1974 | Kuwada | 166/244 C X |

OTHER PUBLICATIONS

Anon., "A Material for Tubing and Casing Applications in Deep, Sour Gas Wells," JPT Forum, Journal of Petroleum Technology, June, 1976, pp. 705–707.

Hamby et al., "Producing Mississippi's Deep, High--Pressure Sour Gas," Journal of Petroleum Technology, June, 1976, pp. 629–638.

Watkins et al., "Corrosion Testing of Highly Alloyed Materials for Deep, Sour Gas Well Environments," Journal of Petroleum Tech., June, 1976, pp. 698–704.

*Primary Examiner*—Stephen J. Novosad

[57] ABSTRACT

One string of corrosion resistant tubing and a casing string which has a corrosion resistant bottom section can be connected between a wellhead and a deep, hot reservoir so that a corrosive reservoir fluid can be produced while keeping it isolated from wellbore or wellhead tubulars of conventional low alloy steel thus preventing corrosion without maintaining a downhole injection of corrosion inhibitor.

10 Claims, 3 Drawing Figures

FIG. 2
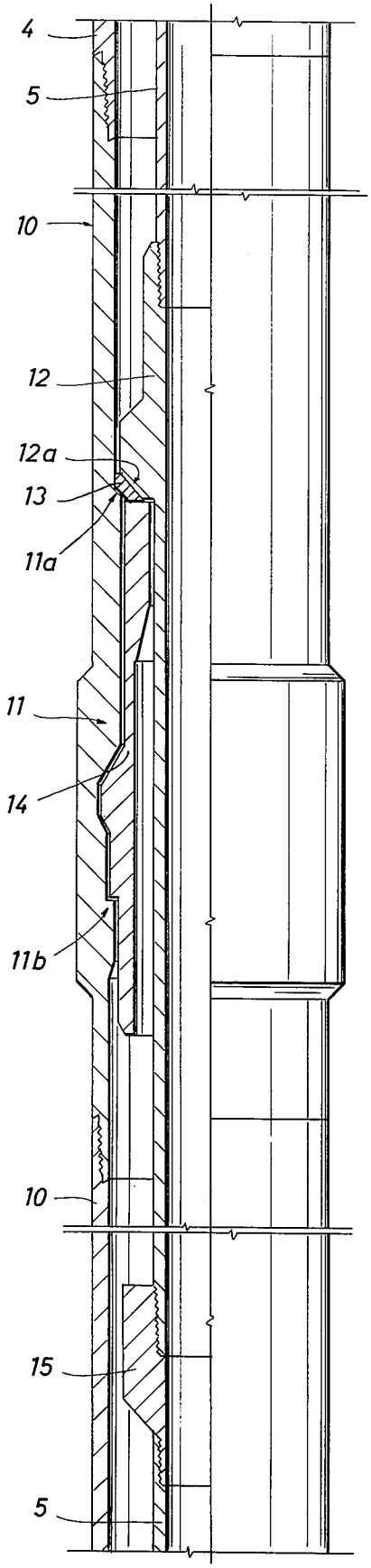
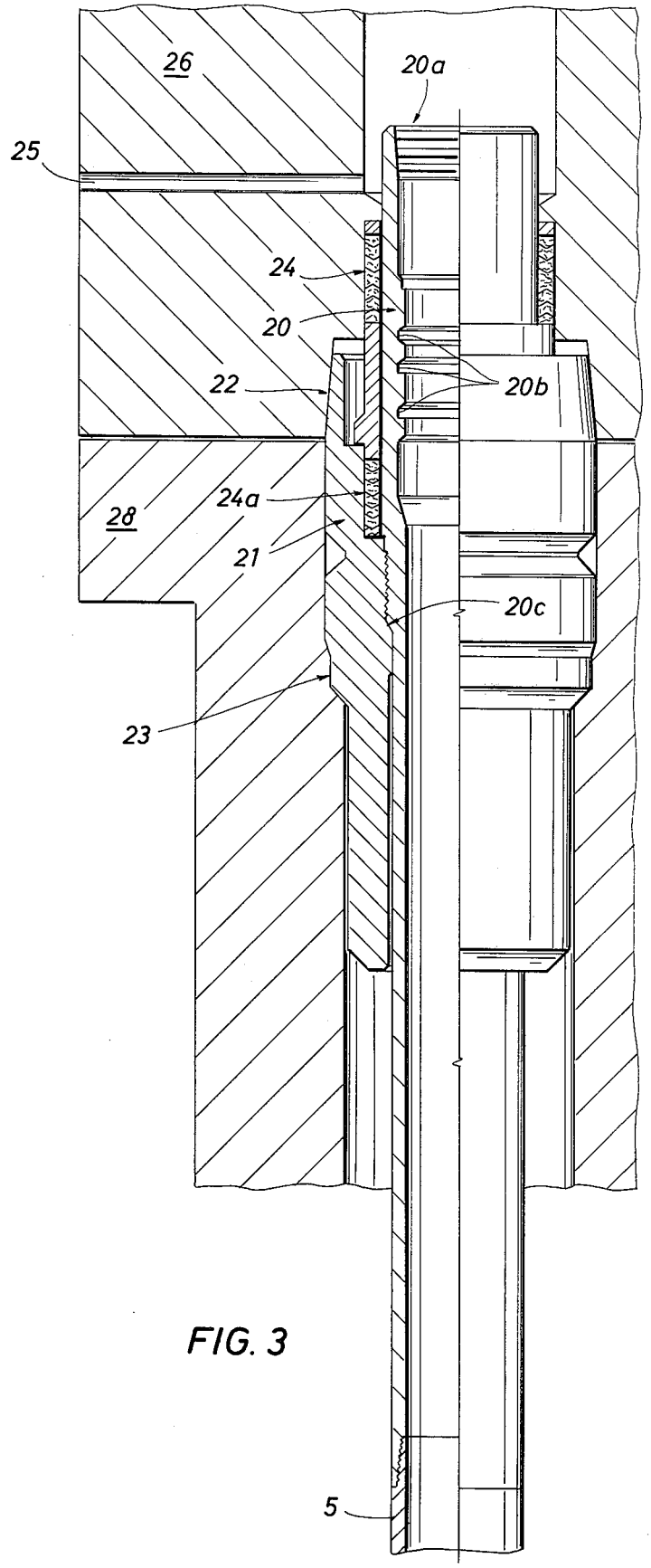
FIG. 3

COMPLETING WELLS IN DEEP RESERVOIRS CONTAINING FLUIDS THAT ARE HOT AND CORROSIVE

BACKGROUND OF THE INVENTION

This invention relates to improving the systems and techniques used for completing wells into deep, hot subterranean reservoirs, such as one which contains a corrosive fluid (such as a gaseous fluid capable of corroding the low alloy steels used in sour gas service) at a pressure above about 15,000 psi, a depth below about 20,000 feet, and a temperature above about 300° F.

Prior proposals for completing wells into such reservoirs and numerous problems which have been encountered in such operations are described in the following publications and the references cited therein: "Producing Mississippi's Deep, High Pressure Sour Gas," T. W. Hamby, L. P. Broussard and D. B. Taylor, Journal of Petroleum Technology, June 1976, page 629; "Corrosion Testing of Highly Alloyed Materials For Deep, Sour Gas Well Environments," M. Watkins and J. B. Greer, Journal of Petroleum Technology, June 1976, page 698; and "A Material For Tubing and Casing Applications in Deep, Sour Gas Wells," J. P. T. Forum, Journal of Petroleum Technology, June 1976, page 705.

The publications indicate that such wells have been completed and corrosive fluids such as highly pressurized sour gas have been produced safely. However, the operations have required specially designed procedures and have involved numerous disadvantages. The conduits and valves and the like devices which confine the high pressures must be designed and constructed with materials, such as low alloy steels, that are arranged to provide enough strength to contain the pressures and yet be below the strength or hardness levels of steels that are susceptible to sulfide stress cracking corrosion at the operating temperature ranges. The publications indicate that although suitable strength and resistance levels have been successfully achieved in steels having a minimum yield strength level of 90 KSI (90,000 psi), significant heat-treating problems are encountered regarding elements having walls thicker than about 0.75 inches. Although certain highly-alloyed super austenitic stainless steel tubular goods are inert to corrosion and have yield strengths in the range of 150 to 250 KSI, the attainment of such strengths often requires a significant amount of cold working and aging. The Multiphase MP35N alloy (available from Standard Press Steel Company) requires a 10 to 55% elongation by cold working and aging; and machines are not currently available for accomplishing this on thick-walled elements. Deep, high pressure, sour gas completion designs which have been successful use no downhole packer between the production casing and tubing strings and require that an inhibitor-containing oil be circulated down through the annulus and into the bottom of the tubing string to continually coat the tubing with a corrosion inhibitor. However, as indicated in the publications, such a circulation may fail to prevent corrosion and may also cause a solids-buildup on the inside and outside of the production tubing string.

SUMMARY OF THE INVENTION

The present invention relates to completing a well into a deep, hot subterranean reservoir that contains a fluid that is corrosive to low alloy steels. A borehole is drilled into the reservoir. A casing string assembly with a bottom portion having a composition capable of resisting corrosion by the reservoir fluid at the reservoir conditions is installed within the borehole so that the corrosion resistant bottom portion extends substantially into or through the reservoir. Welhead components inclusive of a tubing string hanger capable of sealing around and suspending a tubing string within the casing string are installed on the well. A tubing string having a composition capable of resisting corrosion by the reservoir fluid at the reservoir conditions is suspended from the tubing string hanger so that the tubing string extends into the corrosion resistant portion of the casing string. At least one path of the fluid communication is established between the reservoir formation and the interiors of the casing and tubing strings. Fluid is circulated within the casing and tubing strings to the extent required to establish a hydrostatic pressure, within the borehole at the depth of the reservoir, which is less than the fluid pressure within the reservoir. Fluid is produced from the reservoir by allowing an outflow of fluid through the tubing string while injecting fluid into the top of the casing string, within the annulus between the tubing and casing strings, to the extent required to confine substantially all of the produced reservoir fluid within the tubing string and the corrosion resistant portion of the casing string. As the produced reservoir fluid flows up through the tubing string to a point beyond the tubing string hanger it is mixed with a corrosion inhibitor effective for preventing corrosion of low alloy steel used in surface systems.

DESCRIPTION OF THE DRAWING

FIG. 2 shows a downhole packer suitable for use between the production casing and tubing of a well completed in accordance with the present invention.

FIG. 3 shows a sleeve-type hanger arrangement for hanging a corrosion resistant tubing string from a conventional mandrel hanger element within a conventional wellhead.

DESCRIPTION OF THE INVENTION

Figure 1:
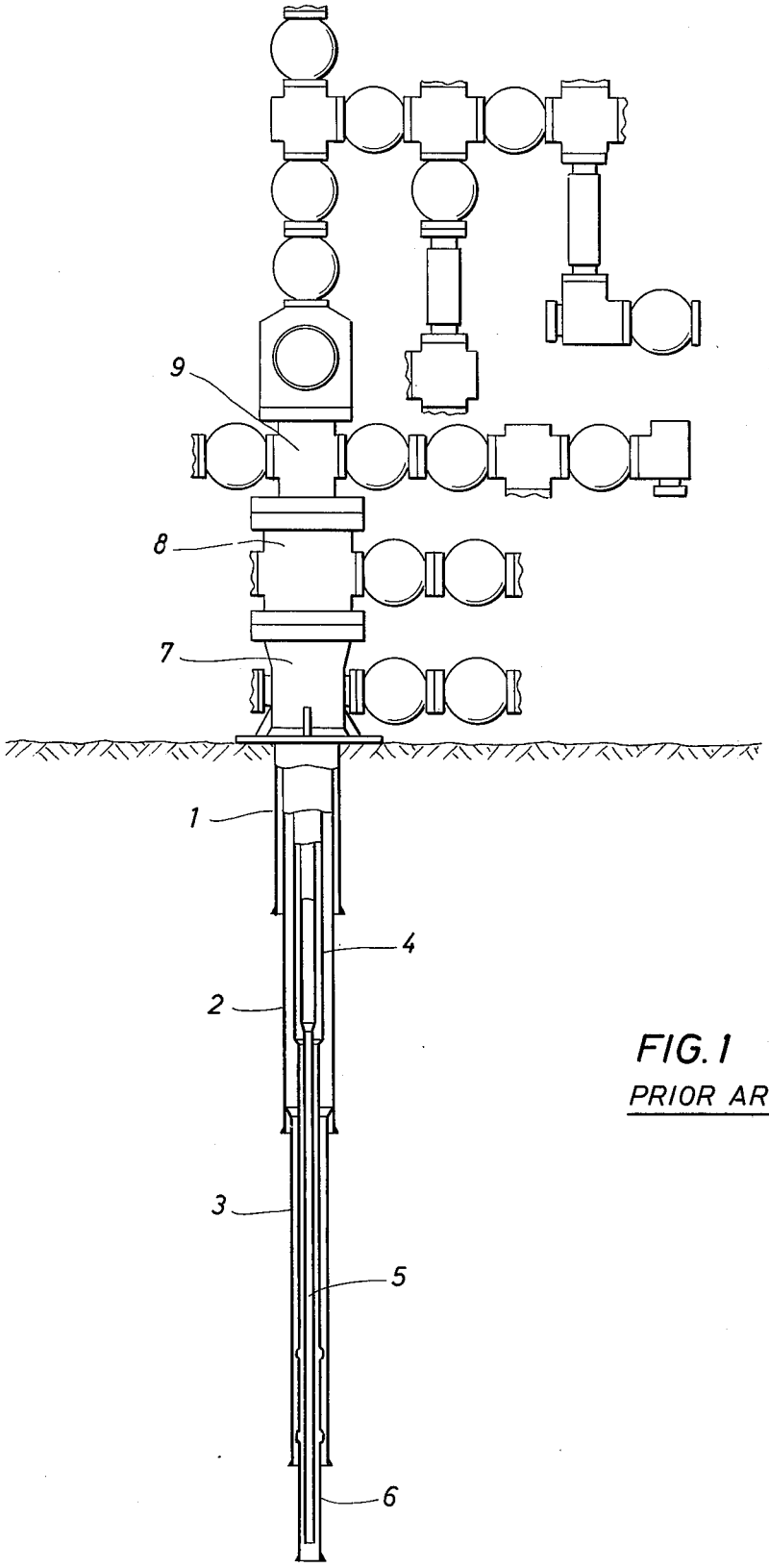
FIG. 1 PRIOR ART
FIG. 1 shows a prior art design of wellhead and downhole arrangement for completing a well in a high pressure, sour gas reservoir.

The present invention provides a way and means for utilizing a single production tubing string assembly composed of material which is sufficiently strong and corrosion resistant to safely confine the corrosive fluid encounterd in a deep, hot reservoir without any downhole application of corrosion inhibiting material. It allows the reservoir fluid to be produced in a manner which materially reduces or substantially eliminates the problems presently encountered in producing fluids from such reservoirs. It also provides a thermally-actuated downhole packer means for totally isolating a corrosive-produced well fluid from conventional wellbore tubulars by means of metal-to-metal seals which remain engaged only as long as reservoir fluids are being produced.

In the present invention, the surface and subsurface components of the wellhead and wellbore installations can, in general, be analogous to those described in the above-mentioned publication: "Producing Mississippi's Deep, High Pressure, Sour Gas" for use in the 30,000/20,000 psi systems. Those components are shown in FIG. 1. In effect, the present invention is a method and apparatus for improving a deep, high pressure well completion system of the type described in that publication.

In the present arrangement, a borehole is drilled into the reservoir and equipped with assemblies of casing and tubing strings, such as those shown in FIG. 1, comprising: surface casing 1, protective casing 2, drilling liner 3, production casing and liner 4, and production tubing 5. The protective and production casing strings and the tubing strings are each suspended from wellhead hangers contained within hanger housing units such as 7, 8 and 9 of the illustrated wellhead arrangement.

As known to those skilled in the art, the outermost casing strings or assemblies are usually bonded to the surrounding earth formations by means of sheaths of cement or other grouting material. In the present invention, although open-hole completions can be used, the production casing and liner assemblies are usually installed through the reservoir interval and subsequently penetrated, e.g., by perforations 6, to provide paths of fluid communication between the reservoir and the interiors of the innermost casing and tubing strings. But, in accordance with the present invention, the bottom portion of the production casing and liner string assembly has an "exotic" corrosion resistant composition capable of resisting corrosion by the reservoir fluid.

FIG. 2 shows a particularly preferred packer arrangement for use in the present invention within the corrosion resistant portion of the casing string. A corrosion resistant casing section 10 is connected to the bottom of a production casing and liner 4. Above section 10, the casing and liner string is preferably composed of low-alloy steels, such as AISI 4130–4140 in the 75–135 KSI minimum yield category, conventionally used for casing strings in deep, sour gas wells. A corrosion resistant thickened recessed locator mandrel 11 is connected into the corrosion resistant section 10. Mandrel 11 is provided with an upward facing, conical sealing ledge 11*a*, and an upward facing "no-go" recess 11*b* for stopping a downward travel of collet fingers adapted to expand into that recess.

In the situation shown, the lower end of the corrosion resistant production tubing string 5 has been connected to a corrosion resistant pack-off mandrel 12 and associated corrosion resistant equipment. The mandrel 12 has been positioned for forming a fluid-tight seal between the casing and tubing strings. The mandrel 12 has a downward facing conical ledge 12*a* which is adapted to form a metal-to-metal seal. A corrosion resistant deformable (low-strength) ring 13 is compressed between the upward and downward facing, conical ledges 11*a* and 12*a*. A retrievable collet locator sleeve 14 has been positioned just below the seal by the entry of its fingers into the no-go recess 11*b* on the casing string. A corrosion resistant collet locator sleeve-retrieval mandrel 15 is attached at a selected distance below the pack-off mandrel 12 on production tubing string 5.

In a preferred procedure for installing the packer-containing casing and tubing string assemblies, the production casing and liner assembly 4 are run-in and installed with the corrosion resistant section 10 and locator mandrel 11 attached to the lower end. This is done while the borehole is filled with a relatively dense fluid providing a hydrostatic pressure sufficient to confine the reservoir fluid with substantially atmospheric pressure at the top of the borehole. The length of the corrosion resistant section 10 is preferably sufficient to extend through the reservoir interval and at least about 15 feet above that interval. The casing string can be cemented or grouted in place by procedures such as those conventionally used in well completing operations.

The production tubing string assembly 5 is run into the borehole while the so-installed casing string and the relatively dense fluid are present within the borehole. Substantially all components of the tubing string assembly have compositions capable of resisting corrosion by the reservoir fluid at the downhole conditions, preferably by being composed of or covered with a highly alloyed super austenitic stainless steel of very high strength and corrosion resistance. The tubing string is provided with pack-off mandrel 12, by threading the mandrel into the tubing string, to provide a down-facing conical ledge 12*a* adapted to form a metal-to-metal seal in conjunction with the up-facing conical ledge 11*a* on the casing string locator mandrel 11. During the run-in of the tubing string, the releasable collet locator-sleeve 14 and a deformable sealing ring 13 are releasably attached, e.g., by shear-pinning, to the tubing string assembly. At a selected distance below the collet locator sleeve, e.g., about 60 feet, the collet sleeve-retrieving mandrel 15 is threaded into the assembly.

The production tubing string assembly is lowered within the casing string until the fingers of the collet locator sleeve 14 engage the no-go ledge in recess 11*b* of the locator mandrel 11 on casing string 4 (the position shown in FIG. 2). Sufficient producing string assembly weight is set on the collet locator sleeve 14 to release the collet locator sleeve from the pack-off mandrel 12 and deform sealing ring 13. The collet locator sleeve then retains the sealing ring in the position shown until retrieved by the sleeve-retrieving mandrel 15, if desired. The tubing string is then picked up at a selected distance, e.g., such as about 5 feet, to ensure an adequate separation of the sealing ledge 12*a* from the deformable ring 13 and the ledge 11*a*.

Wellhead components inclusive of a tubing string hanger capable of sealing around and suspending the tubing string are installed and arranged to hang the tubing string in substantially the position into which it was raised (by picking it up by the procedure described above). At this time, since the fluids are substantially static within the borehole, the average temperature of the fluids and the conduits in the well are near those of the formations overlying the reservoir formation. After hanging the production tubing string assembly, the installation of the wellhead components and the testing of them, for integrity under high pressure and the like, is completed.

As known to those skilled in the art, the amount by which the production tubing string should be raised after the locator sleeve 14 on tubing 5 has contacted the stops of the locator mandrel 11 on casing string 4, are related to the length of the tubing string, and temperature of the reservoir, and the like factors. In deep, sour gas Mississippi wells (of the type discussed in the above publications) the amount by which the tubing string will be lengthened when fluid is produced from the reservoir and the average temperature of the tubing string increases to become near the reservoir temperature, is in the order of 12 feet. In such wells, which have depths in the order of 20,000 feet, a tubing string pickup distance of about 5 feet is desirable to ensure that the pack-off mandrel 12 has been disengaged from the locator mandrel 11 and, subsequently, the full weight of the string hangs from the surface hanger. In such wells, the tubing string can suitably be hung about 5 feet above the point of such a release detection. Then, when the tubing string is thermally expanded, the metal-to-metal seal will be closed but the tubing string will not be deflected beyond suitable elastic limits.

Various procedures can be used to establish a path of fluid communication between the reservoir formation and the interiors of the tubing and casing strings. Where an open hole completion is employed, or where the casing is perforated prior to running the tubing, the establishment of such a path of fluid communication occurs as soon as the tubing string is inserted into the well. Where the reservoir interval has been sealed off by casing and it is desired to perforate the casing while the fluid pressure within the well is less than that in the formation, the perforating operation can be deferred until a heavy fluid, i.e., that used in drilling the well, has been displaced with a light fluid. In such an "underbalanced" perforation procedure, the perforating gun assembly should be inserted through a wellhead pressure-lubricator so that it can be withdrawn while a surface pressure exists at the wellhead.

After completing the installation and testing of the wellhead, fluids are circulated within the tubing and casing strings to the extent required to establish a hydrostatic pressure within the well (at the depth of the reservoir) which is less than the fluid pressure within the reservoir. This ensures that, when there is a path of fluid communication between the reservoir and the interior of the tubing string, the pressure within the tubing string at the wellhead location will become substantially equal to the difference between the hydrostatic pressure of the column of light fluid and the pressure of the fluid in the reservoir. As known to those skilled in the art, the circulating of fluids within the casing and tubing strings can be effected by inflowing fluid through either the tubing string or the annulus between it and the casing string. And, where the fluid to be displaced is both relatively dense and viscous, e.g., a 19.6 ppg oil-based drilling fluid, it may be desirable to effect the displacement in stages. In a staged displacement, the first injected fluid is some but not extensively lighter than the fluid being displaced. This can, of course, be followed by additional incrementally lighter slugs of displacing fluid. Such a circulation is preferably continued until both the tubing and casing strings are freed of the heavy fluid. For example, in the above-mentioned sour gas wells,, a 19.6 ppg drilling fluid is first displaced with 12 ppg drilling fluid and then with 7 ppg diesel oil. When communication is established with the reservoir this results in about 10,000 psi surface pressure.

FIG. 3 shows a preferred sleeve-type of arrangement for hanging a production string having a composition capable of resisting corrosion of the reservoir fluid (within a wellhead composed predominately of conventional low-alloy steel) so that (a) the produced corrosive fluid is kept isolated from all corrodible components until the outflowing produced fluid reaches a surface location at which it is mixed with an effective proportion of corrosion inhibitor, and (b) the wall-thicknesses of the "exotic" corrosion resistant materials are kept within ranges which can be effectively cold worked and aged with currently available machines. A corrosion resistant tubing string 5 is threaded into a top thick-walled section 20, such as a section comprising a coupling stock formed from the same material. For example, where the corrosion resistant material is an exotic alloy, such as MP35N, the dimensions of a coupling stock are such that the material can be subjected to adequate cold working and aging, with the currently available machinery, to provide the necessary strength and freedom from stress. The production tubing top section 20 can be threaded at **20*a*, or otherwise arranged, to allow the tubing hanger assembly (and tubing) to be lowered into the hanger housing body 28 through the blowout preventers in a conventional manner. The tubing top can be internally grooved, at 20*b*, for retaining a tubing string safety plug (e.g., in the conventional manner) during the removing of blowout preventors and installing of wellhead valves, etc. The tubing top is threaded at 20*c* to provide a metal-to-metal sealing connection to a conventional low-alloy steel material mandrel hanger element 21 capable of being incorporated into a conventional wellhead system. The hanger element 21 is sealed to other components (not detailed), such as wellhead valve body 26 and hanger housing body 28, of a conventional type of wellhead by means of metal-to-metal seals 22 and 23 which are supplemented, for pressure testing, by trapped teflon secondary seals 24 and 24*a***.

An inlet port 25 (or other conduit) is arranged to convey fluid from a near surface facility to a near surface location such as a location within the wellhead in which produced fluid outflowing from the top section of production tubing 5 comes into contact with corrodible materials such as low alloy steel wellhead valves, etc. The inlet port 25 is used during the production of corrosive fluid from the reservoir to mix corrosion inhibitor with the produced fluid substantially as soon as it flows beyond the tubing hanger. In such an operation substantially any corrosion inhibitor for inhibiting the corrosion of low alloy steel materials can be used. Preferably the corrosion inhibitor is a liquid materials or is dissolved in a liquid.

After the installation and testing of the wellhead components, the well is made ready for the production of reservoir fluid by steps inclusive of connecting a source of corrosion inhibitor fluid to the inlet port 25 on the wellhead and connecting a source of relatively light liquid (such as that circulated into the tubing and casing strings to displace the heavy liquid) to an inlet through the wellhead (not shown) into the annulus between the production tubing string 3 and the casing string 4. Fluid is allowed to flow out through the production tubing string while relatively light fluid is injected into the annulus between the tubing and casing strings. The amount of light fluid injected should be enough to confine substantially all of the reservoir fluid (which then begins to flow from the reservoir into the well) within the tubing string and corrosion resistant portion of the casing string. At least as soon as the fluid outflow is sufficient for reservoir fluid to have flowed up to and beyond the tubing top, a corrosion inhibitor-containing fluid is injected, e.g., through port 25, so the inhibitor becomes mixed with substantially each portion of produced reservoir fluid which has reached that location.

Where the well is equipped with the thermally-actuated downhole packer of FIG. 2, the packer seals are initially unseated (since the average temperature of the tubing string is near that of the overlying earth formation). When production is initiated, the amount of fluid injected into the annulus between the tubing and casing string (to confine the reservoir fluid within the tubing string) is preferably kept near the minimum required to ensure a downflow of that fluid. The rate of that flow need only be sufficient to overcome the rate of diffusion of the reservoir fluid up into the fluid in that annulus. As the production tubing string becomes heated by the upflowing of the reservoir fluid its average temperature increases to near that of the reservoir temperature and its thermal elongation closes the sealing elements of the downhole packer. Such a seating of the packer sealing elements is detectable by a rise in the injection pressure required to cause an inflow of fluid into the top of the casing. The inflowing of fluid into the casing is preferably throttled back so that the flow is terminated with a significant surface pressure remaining in the top of the casing.

The sealing elements of the downhole packer are opened by terminating the flow of reservoir fluid long enough to allow the temperature of the production tubing string to return to near that of the overlying earth formations. The opening of those sealing elements is detectable by the capability of circulating fluid from the casing string to the tubing string. Such an opening of the downhole packer sealing elements can be effected in order to provide a passageway for circulating both the relatively light fluid and the produced fluid out of the casing and tubing strings. This can be accomplished by injecting a heavy well-control or work-over fluid into the top of the casing string-tubing string annulus at least as fast as fluid is allowed to flow out through the tubing string. If desired, the column of produced fluid within the tubing string can be displaced back into the reservoir formation by means of an adequately pressurized injection of fluid into the top of the tubing string. A relatively rapid replacement of the hot fluid with a cooler fluid increases the rate of cooling of the tubing string and the rate of opening the sealing elements within the downhole packer.

The present invention can be employed without using the thermally actuated downhole packer. In this embodiment a casing string having a corrosion resistant bottom portion is installed in the manner described above. A corrosion resistant tubing string is then run-in and installed substantially as described above, except for the omission of the sealing elements and procedures associated with the downhole packer. Alternatively, a corrosion resistant tubing string can be equipped with a corrosion resistant packing means (of a conventional design for packing off the space between the tubing and casing strings in response to a mechanical actuation) and run-in and manipulated as required to seat the packer.

Where a well is completed in accordance with the present invention without using a downhole packing device, it is necessary to continuously inject fluid into the casing string-tubing string annulus at a rate sufficient to confine the reservoir fluid being produced within the corrosion resistant portion of the casing string. During such an operation the construction and arrangement of the surface and downhole well equipment can be substantially equivalent to the prior art arrangement (shown in FIG. 1) except for the corrosion resistant bottom section of the production casing and liner string 4, and the corrosion resistant production tubing string 5. However, the present invention provides a significant advantage. It eliminates the need for transporting an effective amount of corrosion inhibitor into the deep and hot downhole location. Such a transporting of corrosion inhibitor requires maintaining an effective phase relationship between the inhibitor and the carrier fluid all the way down through the casing string-tubing string annulus and into the bottom of the tubing string.

In the present invention, the only fluid that need be transported down through the casing string-tubing string annulus is enough inert fluid to provide a flow rate and pressure that confines the inflowing reservoir fluid within the corrosion resistant portion of the casing string and the interior of the tubing string. In the present invention, the situation created by the omission of the thermally actuated or other downhole packer is equivalent to that provided when the sealing elements of the packer are open. In this situation, the present invention provides flow paths for circulating a reservoir-treating fluid to be used for stimulating the production interval, or the like, without first subjecting the reservoir to any significant amount of invasion by undesirable well fluids. The invasion can be avoided by circulating fluids within the tubing and casing strings while controlling the inflow and outflow pressures so that little or no fluid is forced into the reservoir. Such a circulation procedure also can be used to transport measuring means such as pump-down devices for calibrating the tubing string, for measuring bottom-hole pressure, for measuring flow volume, or the like. A similar circulation procedure can be used for circulating chemicals to remove deposits, such as sulfur, from the wellbore and/or wellbore tubulars without disturbing the permanently installed wellhead equipment.

The term "composed of an exotic material" or a "corrosion resistant material" are used herein, with reference to flow-confining elements such as conduits, valves, packers, and the like, having compositions capable of resisting corrosion by the reservoir fluid at the pressure and temperature of the reservoir. Such corrosion resistant devices can be composed entirely of or lined or coated (over all of their exposed surfaces) with corrosion resistant material. Particularly suitable corrosion resistant materials comprise the highly alloyed super austenitic stainless steels having yield strengths in the range of 150 to 250 KSI, such as Multiphase MP35N (available from Standard Press Steel Company), Inconel 625 (available from Huntington Alloys, Hastalloy C-276 (available from Cabot Corporation), and the like. As indicated in the above-mentioned publications, uses of such materials in accordance with the present invention can increase flow capacity of deep, high pressure wells by providing sufficient strengths in flow confining elements having thinner walls and by providing increased burst collapse and tension resistances which reduce the risks of well loss.

The terms "low alloy steel" or "low alloy steel conventionally used in deep, sour gas wells" as used herein, refer to low alloy steels having strengths and corrosion resistance properties at least substantially equivalent to an AISI 4130–4146 steel in the 75–135 KSI minimum yield category.

The present invention is particularly applicable to any relatively deep, hot, highly pressurized reservoir but is also applicable to any reservoir that contains a fluid which is corrosive to the low alloy steel conventionally used in deep, sour gas wells. Such reservoirs can comprise geothermal reservoirs, reservoirs that contain mixtures of alkali metal halide solutions and $CO_2$ or the like corrosive fluids.

What is claimed is:

1. A well completing process which comprises:

drilling a borehole into a relatively deep, hot, highly pressurized subterranean reservoir which contains fluid which, at the reservoir conditions, is corrosive to low alloy steel;

installing in the borehole a casing string assembly in which the bottom portion has a corrosion resistant composition capable of resisting corrosion by the reservoir fluid at the reservoir conditions, with said bottom portion being at least about 20 feet long and being arranged to extend substantially into or through the reservoir interval;

equipping the borehole with wellhead components inclusive of a tubing string hanger capable of suspending and sealing around a tubing string extending within the casing string;

suspending a tubing string having a composition capable of resisting corrosion by the reservoir fluid at the reservoir conditions from the tubing hanger so that the tubing string extends into the corrosion resistant portion of the casing string;

establishing at least one path of fluid communication between the reservoir and the interiors of the tubing and casing strings;

circulating fluids within the tubing and casing strings to the extent required to establish a hydrostatic pressure within the bore-hole, at depth of the reservoir, which is less than the fluid pressure within the reservoir;

producing fluid from the reservoir by allowing an outflow of fluid through the top of the tubing string while injecting fluid into the top of the casing string-tubing string annulus at a rate and pressure sufficient to confine substantially all of the reservoir fluid that enters the borehole within the tubing string and the corrosion resistant portion of the casing string; and as reservoir fluid flows up through the tubing string to a point beyond the tubing hanger, mixing substantially each portion reaching that location with a corrosion inhibitor effective for substantially preventing its corroding of a low alloy steel.

2. The process of claim 1 in which:

a corrosion resistant upward facing conical sealing ledge is connected into the corrosion resistant portion of the casing string;

a corrosion resistant downward facing conical sealing ledge adapted to mate with the ledge in the casing string is connected into the tubing string; and the length of the tubing string is arranged so that, when the average temperature of the tubing string is near that of the formations overlying the reservoir, the sealing ledges are separated, but when the average temperature of the tubing string is near the reservoir temperature the expansion of the tubing string engages the sealing ledges and holds them in substantially fluid-tight engagement.

3. The process of claim 2 in which:

the downhole sealing ledges are subsequently disengaged by terminating the upflow of reservoir fluid and allowing the average temperature of the tubing string to decrease; and fluid is circulating within the tubing and/or casing string to the extent required to position a selected fluid within the borehole at the depth of the reservoir.

4. The process of claim 1 in which all of the reservoir fluid-contacted surfaces of the corrosion resistant tubing string and bottom portion of the casing string are composed of highly alloyed, super austinitic strength steels having yield strengths in the range of 150 to 250 KSI.

5. The process of claim 4 in which substantially all of the remaining portions of the tubing and casing string assemblies are composed of low alloy steels having strength and corrosion resistance properties at least substantially equivalent to those of an AISI 4130–4146 steel in the 75–135 KSI minimum yield category.

6. A well completing and operating process which comprises:

drilling a borehole into a relatively deep, hot, highly pressurized subterranean reservoir which contains fluid which at reservoir conditions is corrosive to low alloy-steel;

installing in the borehole a casing string assembly in which the bottom portion has a corrosion resistant composition capable of resisting corrosion by the reservoir fluid at reservoir conditions, with said bottom portion being at least about 20 feet long and being arranged to extend substantially into or through the reservoir interval;

equipping the borehole with wellhead components inclusive of a tubing string hanger capable of suspending and sealing around a tubing string extending within the casing string;

suspending a tubing string having a composition capable of resisting corrosion by the reservoir fluid at reservoir conditions from the tubing hanger so that the tubing string extends into the corrosion resistant portion of the casing string;

establishing at least one path of fluid communication between the reservoir and the interiors of the tubing and casing strings;

circulating fluids within the tubing and casing strings to the extent required to establish a hydrostatic pressure within the borehole at depth of the reservoir which is less than the fluid pressure within the reservoir;

producing fluid from the reservoir by allowing an outflow of fluid through the top of the tubing string while injecting fluid into the top of the casing string-tubing string annulus at a rate and pressure sufficient to confine substantially all of the reservoir fluid that enters the borehole within the tubing string and the corrosion resistant portion of the casing string;

as reservoir fluid flows up through the tubing string to a point beyond the tubing hanger, mixing substantially each portion reaching that location with a corrosion inhibitor effective for substantially preventing its corroding of a low alloy steel; and subsequently circulating fluids within the tubing and casing strings to the extent required to establish a hydrostatic pressure within the tubing and casing strings which is more than the fluid pressure within the reservoir.

7. The process of claim 6 in which:

a corrosion resistant upward facing conical sealing ledge is connected into the corrosion resistant portion of the casing string;

a corrosion resistant downward facing conical sealing ledge is connected into the corrosion resistant portion of the casing string;

a corrosion resistant downward facing conical sealing ledge adapted to mate with the ledge in the casing string is connected into the tubing string; and the length of the tubing string is arranged so that when the average temperature of the tubing string is near that of the formations overlying the reservoir the sealing ledges are separated, but when the average temperature of the tubing string is near the reservoir temperature the expansion of the tubing string engages the sealing ledges and holds them in substantially fluid-tight engagement.

8. The process of claim 6 in which:

the downhole sealing ledges are subsequently disengaged by terminating the upflow of reservoir fluid and allowing the average temperature of the tubing string to decrease; and fluid is circulating within the tubing and/or casing string to the extent required to position a selected fluid within the borehole at the depth of the reservoir.

9. The process of claim 6 in which all of the reservoir fluid-contacted surfaces of the corrosion resistant tubing string and bottom portion of the casing string are composed of highly alloyed, super austinitic strength steels having yield strengths in the range of 150 to 250 KSI.

10. The process of claim 9 in which substantially all of the remaining portions of the tubing and casing string assemblies are composed of low alloy steels having strength and corrosion resistance properties at least substantially equivalent to those of an AISI 4130–4146 steel in the 75–135 KSI minimum yield category.

* * * * *